US008449290B2

(12) United States Patent
Tsai

(10) Patent No.: US 8,449,290 B2
(45) Date of Patent: May 28, 2013

(54) GAS COMBUSTOR

(76) Inventor: Chih-Lin Tsai, New Taipei (TW)

( * ) Notice: Subject to any disclaimer, the term of this patent is extended or adjusted under 35 U.S.C. 154(b) by 183 days.

(21) Appl. No.: 13/186,938

(22) Filed: Jul. 20, 2011

(65) Prior Publication Data

US 2012/0045727 A1 Feb. 23, 2012

(30) Foreign Application Priority Data

Aug. 19, 2010 (TW) ..... 99127704 A

(51) Int. Cl.

| | |
|---|---|
| ***F23D 14/28*** | (2006.01) |
| ***F23Q 2/173*** | (2006.01) |
| ***F23Q 7/12*** | (2006.01) |
| ***F23Q 7/24*** | (2006.01) |

(52) U.S. Cl.
USPC ..... 431/153; 431/255; 431/344

(58) Field of Classification Search
USPC ..... 431/253, 254, 255, 256, 344, 345, 431/153; 126/405–407, 229, 231, 232, 234
See application file for complete search history.

(56) References Cited

U.S. PATENT DOCUMENTS 5,466,149 A * 11/1995 Tsai ..... 431/344
5,725,369 A * 3/1998 Tsai ..... 431/344
5,771,880 A * 6/1998 Tsai ..... 126/414
6,022,212 A * 2/2000 Saito et al. ..... 431/153
2010/0021854 A1* 1/2010 Kotani ..... 431/153

* cited by examiner

*Primary Examiner* — Kenneth Rinehart
*Assistant Examiner* — Patrick Nutbrown
(74) *Attorney, Agent, or Firm* — Guice Patents PLLC

(57) ABSTRACT

The present invention relates to a gas combustor, which comprises a housing in which a base seat is installed, an engagement pipe at the front of the base seat is connected to a flame device exposed at the front of the housing, wherein the rear portion of the base seat is pivoted with a swing sheet, the inner surface thereof is adjacent to a gas intake control valve fastened in the base seat, and a convey pipe is connected between the gas intake control valve and a pivotal connection device installed at the rear of the housing; and a safety mechanism, installed at the bottom of the housing and including a latch button, a connection rod and a control button; through pressing the latch button, one end of the connection rod is raised, the latch end at the other end of the connection rod is inwardly retracted for releasing the locking state of the control button, so the control button is enabled to be pressed, and the extrusion part extrudes the swing sheet, and the gas intake control valve is formed to an opening state, so the fuel is able to pass through the interior of the base seat for being ejected by the flame device.

17 Claims, 13 Drawing Sheets

GAS COMBUSTOR

BACKGROUND OF THE INVENTION

1. Field of the Invention

The present invention relates to a gas combustor, especially to a gas combustor having safety mechanism and pressure stabilizing mechanism, wherein when the safety mechanism is not operated, the gas combustor is in a locking state, after the safety mechanism is released and operated, ignition and combustion gas supply can be synchronously processed.

2. Description of Related Art

Gas combustors are commonly seen and used in our daily lives. But for a child, he/she may play with a gas combustor without being supervised because of his/her curiosity or imitating the adults. Therefore, a fire accident may occur due to the careless act and our lives and properties may be in danger. As such, in many cases, fire accidents caused by children playing with fire cannot be ignored. In a conventional gas combustor, the design of ignition switch is easy to be released based on the object of convenient in use, such design give the children a chance to play with the gas combustor, and unpredictable consequences become inevitable.

For the safety reasons, countries like the America and European Union have issued safety regulations regarding to gas combustor, and each gas combustor is required to be installed with a safety actuation device, take the U.S. Pat. No. 6,293,782 (corresponding to the Taiwan Patent NO. 446104), the U.S. Pat. No. 6,296,476 (corresponding to the Taiwan Patent NO. 449018), the U.S. Pat. No. 6,527,543 (corresponding to the Taiwan Patent No. 525749) and the U.S. Pat. No. 6,688,879 (corresponding to the Taiwan Patent NO. 534277) issued to the applicant of the present invention for instances, when a gas combustor is not operated, it is in a locking state; if the gas combustor is desired to be used, the safety actuation device has to be released before being operated. Because the releasing procedure increases the level of difficulty in use, a child could not release the locking state while playing with the gas combustor, thereby occurrences of accidents are decreased.

In fact, for providing the continuity for the combustion operation, a gas combustor may be directly pivoted to a canned gas, such act allows the combustion gas ejected by the gas combustor generate larger flame due to the high pressure releasing, for processing the continuous and large-scale combustion operation. However, when a user is processing a welding, soldering or drying operation, the canned gas is often used in an upside down manner. At this moment, the liquid gas may not be vaporized in time due to the high pressure releasing, so as to be ejected from the flame nozzle in the liquid state, incomplete combustion is therefore generated, thereby the combustion efficiency cannot be increased and accidents may take place.

Moreover, in some locations with lower temperature, because the environmental temperature is low, during the transformation from liquid to gaseous state in a canned gas, an incomplete oxidization may occur, thereby the combustion tool is not easy to be ignited.

As such, how to enable a gas combustor to effectively control the pressure of combustion gas for keeping in a constant pressure is an issue which shall be solved.

SUMMARY OF THE INVENTION

One primary object of the present invention is to provide a gas combustor having a safety mechanism, when a latch button of the safety mechanism is pressed, a control button is then enabled to be pressed, and the control button can be used to synchronously supply combustion gas and ignition, for processing the combustion operation.

For achieving the mentioned object, one solution provided by the present invention is to provide a gas combustor, which comprises:

a housing in which a base seat is installed, an engagement pipe at the front of the base seat is connected to a flame device exposed at the front of the housing, wherein the rear portion of the base seat is pivoted with a swing sheet, the inner surface thereof is adjacent to a gas intake control valve fastened in the base seat, and a convey pipe is connected between the gas intake control valve and a pivotal connection device installed at the rear of the housing; and a safety mechanism, installed at the bottom of the housing and including:

a latch button, longitudinally sleeved with a first resilient member, the top of the first resilient member is abutted in the housing, the top of the latch button is pivoted to one end of a connection rod, a bended portion of the connection rod is pivoted in the housing, and the other end of the connection rod being protrudingly formed with a latch end toward a control button; and a control button, the top opening is formed with a stop end at the location adjacent to the latch end, the stop end is formed in a locking state due to the interfere of the latch end; the interior of a hollow button chamber of the control button is longitudinally sleeved with a second resilient member, the top end of the second resilient member is abutted in the housing, and the top front of the control button is formed with an extrusion part;

through pressing the latch button, one end of the connection rod is raised, the latch end at the other end of the connection rod is inwardly retracted for releasing the locking state of the control button, so the control button is enabled to be pressed, and the extrusion part extrudes the swing sheet, and the gas intake control valve is formed to an opening state, so the fuel is able to pass through the interior of the base seat for being ejected by the flame device.

DETAILED DESCRIPTION OF THE PREFERRED EMBODIMENT

Figure 1:
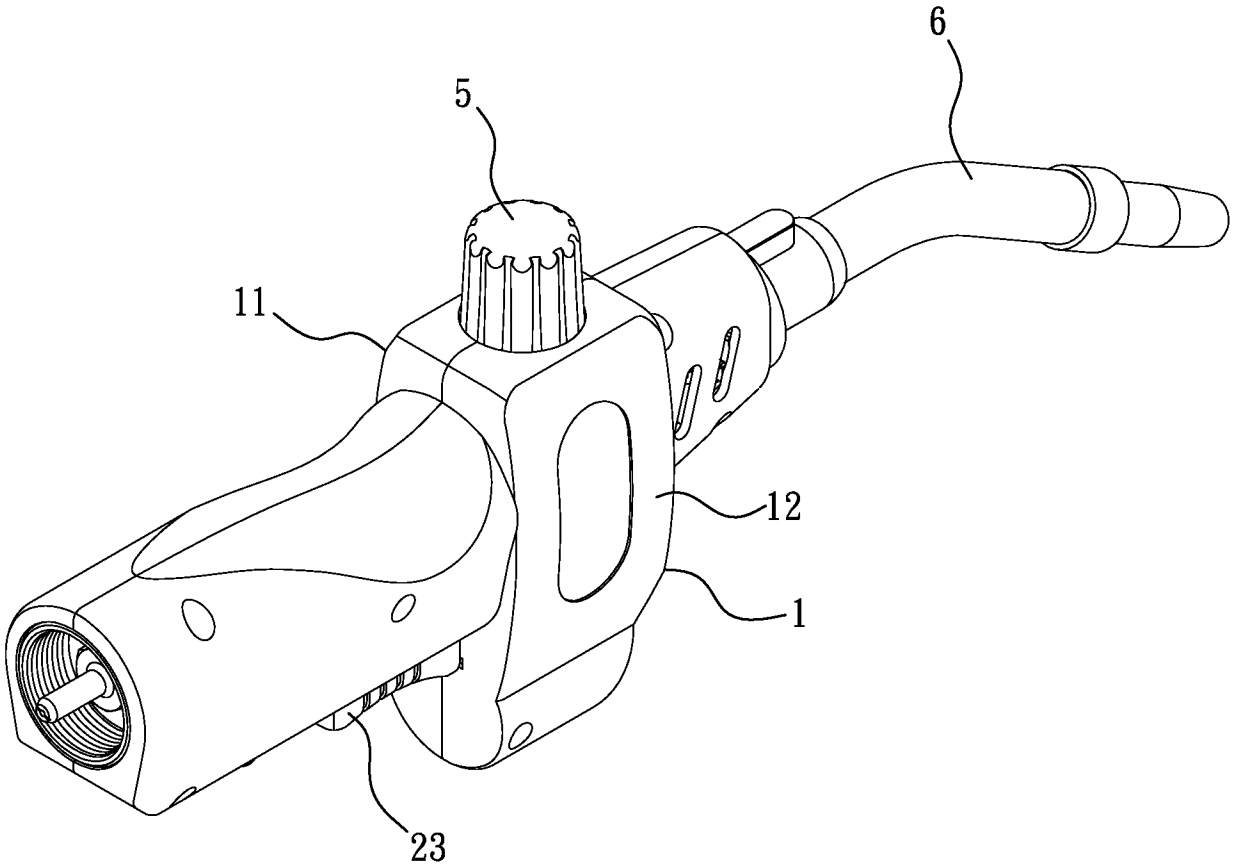
FIG. 1 and FIG. 2 are perspective views illustrating the gas combustor taken from two different viewing angles, accord to the present invention.

As shown from FIG. 1 to FIG. 8*b*, the gas combustor provided by the present invention substantially comprises a housing 1, a safety mechanism 2, a base seat 3, a pivotal connection device 4, a pressure stabilizing device 5 and a flame device 6.

Figure 2:
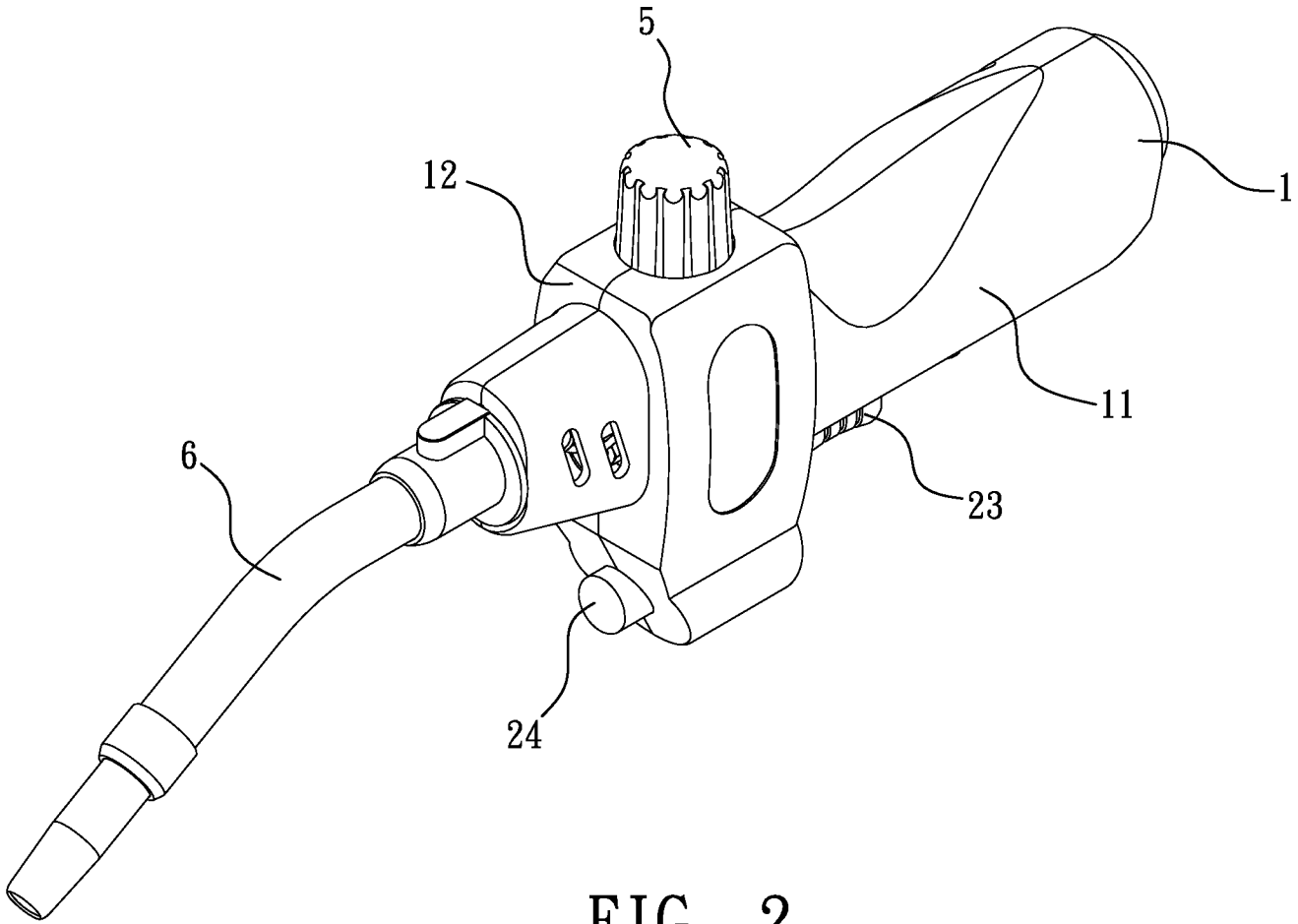

The housing 1 is composed of a left housing shell 11 and a right housing shell 12 being engaged for housing other components, and plural tenons, slots, ribs are installed in the two housing shells for positioning and accommodating the other components. The assembly of the gas combustor of the present invention is shown in FIG. 1 and FIG. 2, wherein the front of the housing 1 is detachably installed with the flame device 6 having various gas guiding components 65 with respect to the desired flame, and the bottom and the top of the housing 1 respectively allow plural button members of the safety mechanism 2 and a pressure adjusting button 56 of the pressure stabilizing device 5 to be exposed to the exterior, and the rear thereof is installed with the pivotal connection device 4 for being connected with a canned gas.

The safety mechanism 2 consists of a latch button 21, a connection rod 22 and a control button 23. The mentioned two buttons are respectively and protrudingly installed at an opening 13 preset at the bottom of the housing 1. The interior of the latch button 21 is longitudinally sleeved with a first resilient member 211 e.g. a spring, and the top thereof is abutted against a block sheet 14 preset in the left housing shell 11, and the top of the latch button 21 is transversally extended with a pivot shaft 212 pivoted in an elongated shaft hole 221 formed at one end of the L-shaped connection rod 22, the other end of the connection rod 22 is protrudingly installed with a latch end 222, a pivot hole 223 formed at the bended portion of the connection rod 22 is pivoted with the insertion pins 15 protrudingly formed in the left housing shell 11 and the right housing shell 12. Accordingly, as shown in FIG. 8*a* and FIG. 9*a*, when the latch button 21 is pressed, one end of the connection rod 22 is raised so the latch end 222 at the other end is inwardly retracted, thereby the locking state of the control button 23 is released and the control button 23 is enabled to be pressed.

Figure 3:
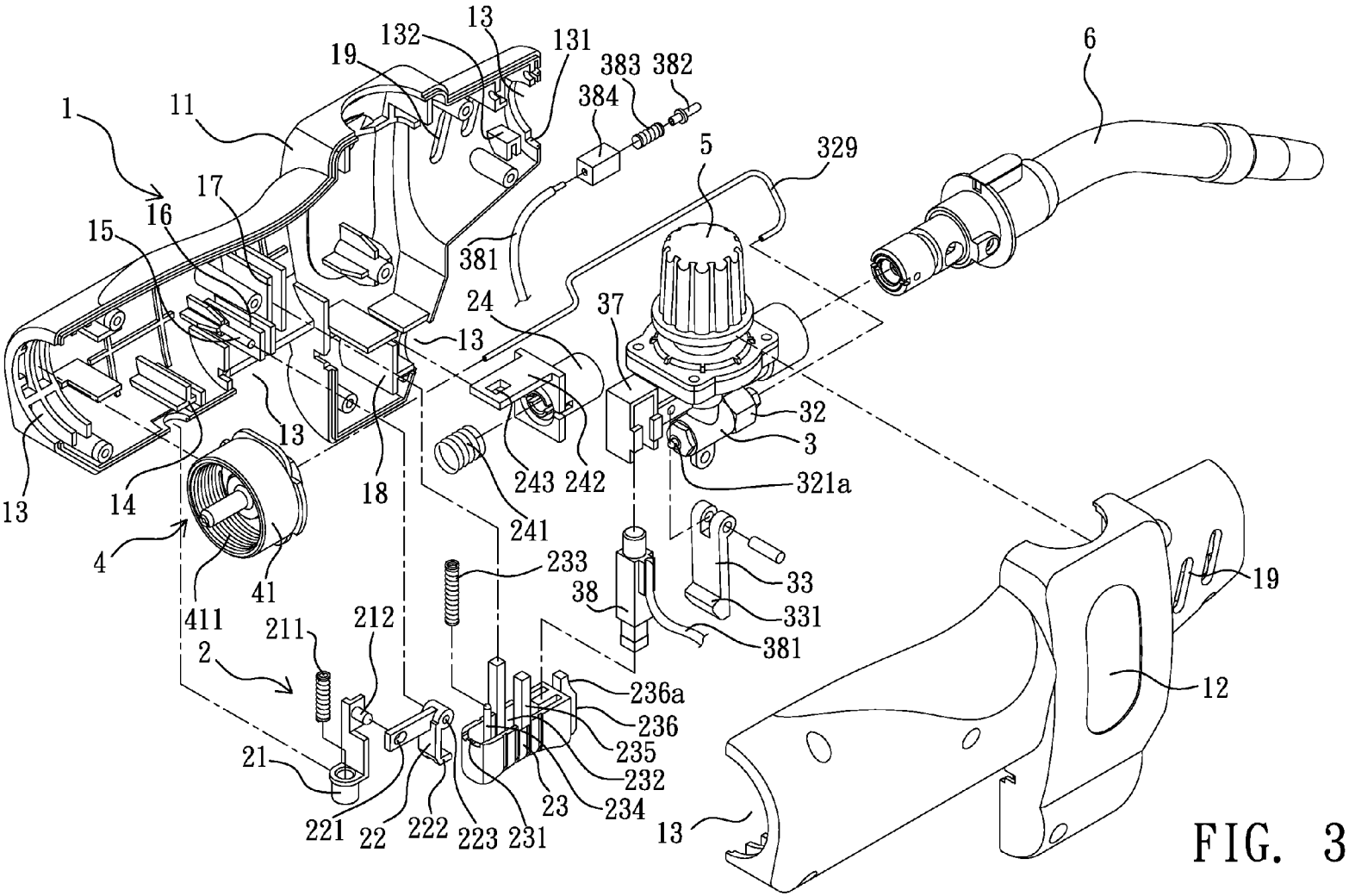
FIG. 3 and FIG. 4 are exploded perspective views illustrating the gas combustor taken from two different viewing angles, accord to the present invention.
Figure 4:
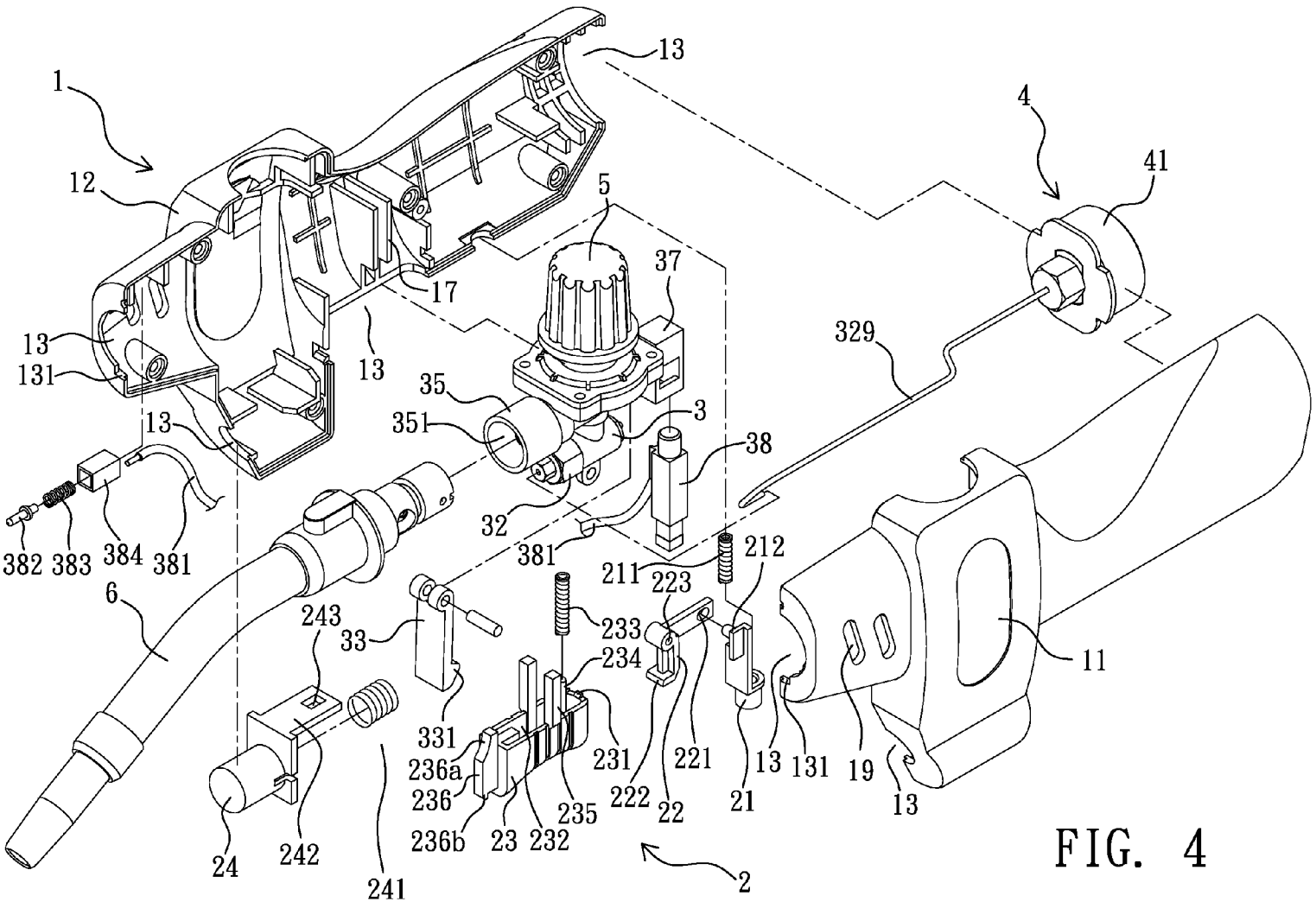
Figure 8A:
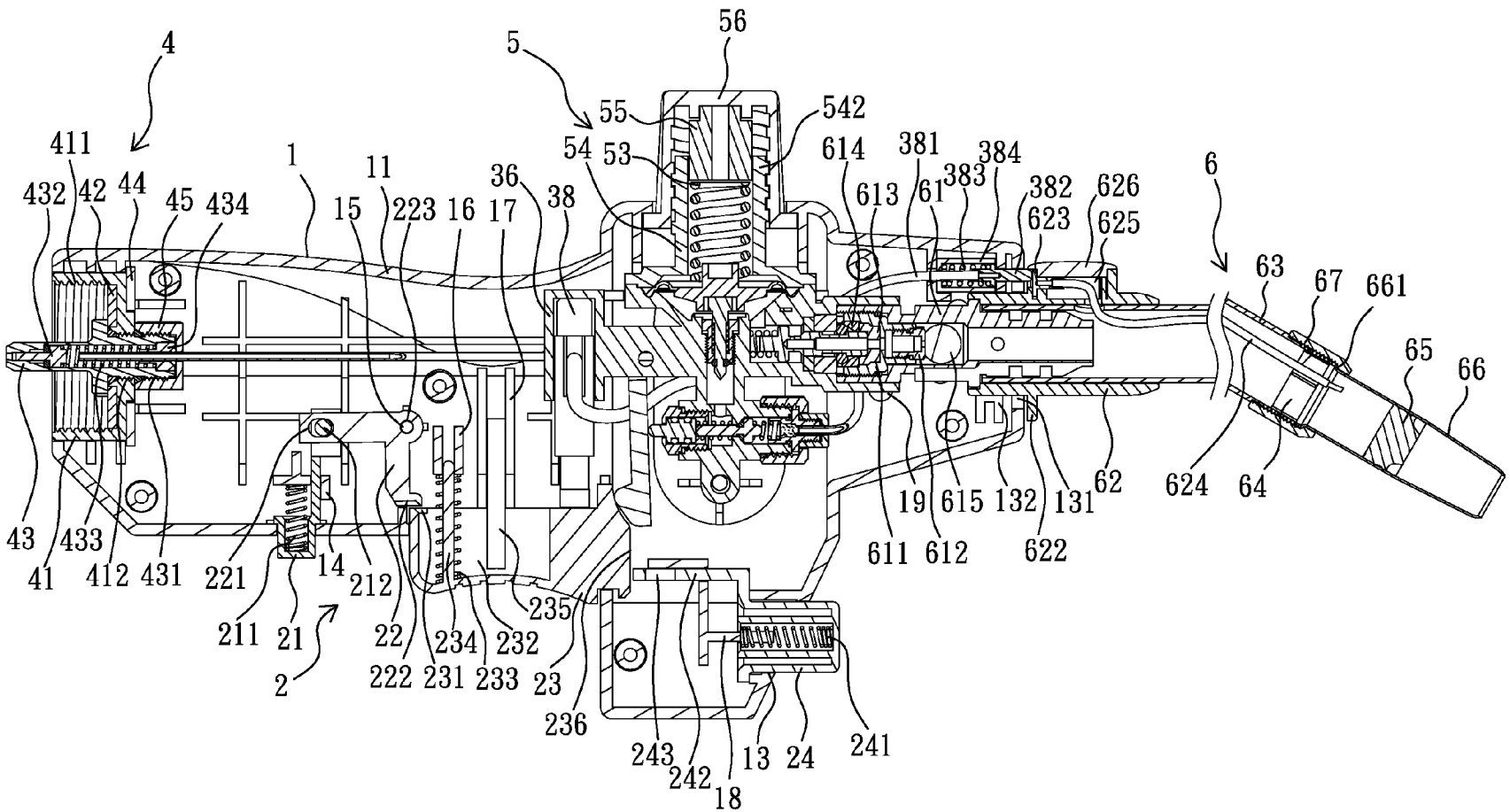
FIG. 8*a* is a cross sectional view illustrating the gas combustor being in the locking state, according to the present invention.
Figure 9A:
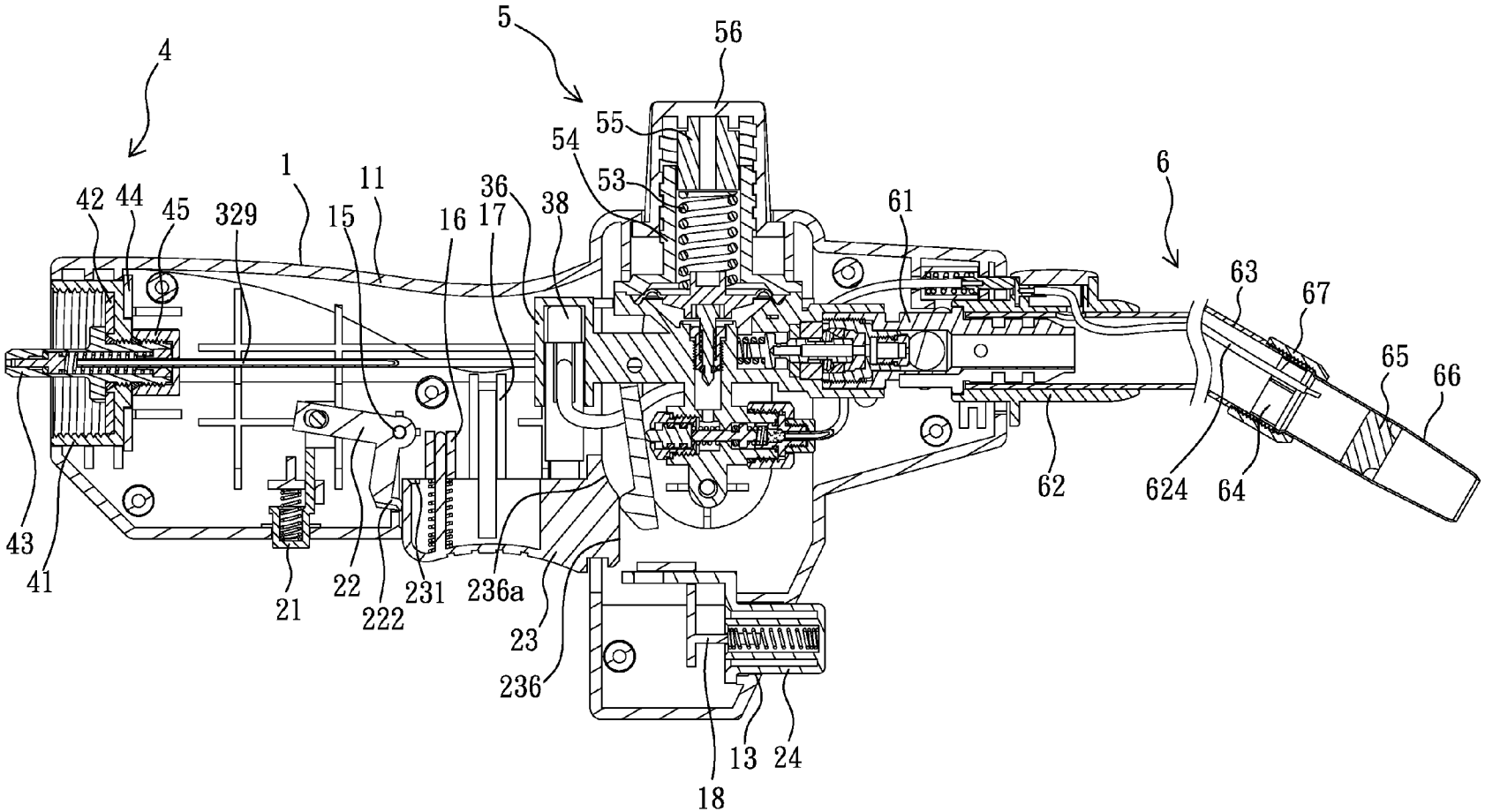
FIG. 9*a* is a cross sectional view illustrating the gas combustor being released for ignition, according to the present invention.

The control button 23 is a cap member, the top opening thereof is formed with a stop end 231 at the location adjacent to the latch end 222 of the connection rod 22, as shown in FIG. 8*a*, the stop end 231 is formed in a locking state due to the interfere of the latch end 222. A hollow button chamber 232 of the control button 23 is longitudinally sleeved with a second resilient member 233, e.g. a spring, which is sleeved in a button tenon 234 protrudingly installed in the button chamber 232, the top of the second resilient member 233 is abutted against a pair of block tenons 16 preset in the left housing shell 11, so the control button 23 is equipped with an automatic recovery force. The left and the right sides of the control button 23 are oppositely protruded with a pair of guide posts 235 which are respectively accommodated in the guide slots 17 formed in the housing 1, such that the control button 23 is enabled to smoothly and longitudinally slide in the housing 1. Moreover, the front of the control button 23 is formed with a protruding rib 236, e.g. the top and the bottom of the protruding rib 236 are respectively formed with an extrusion part 236*a* and a buckle part 236*b*; as shown in FIG. 3 and FIG. 4, the extrusion part 236*a* is an inward-inclined surface and the buckle part 236*b* is a convex tenon. As shown in FIG. 9*a*, the extrusion part 236*a* can be used to extrude a swing sheet 33 pivoted to the base seat 3, so as to control a gas intake control valve 32 installed in the base seat 3 for forming a combustion gas supply state.

Figure 10A:
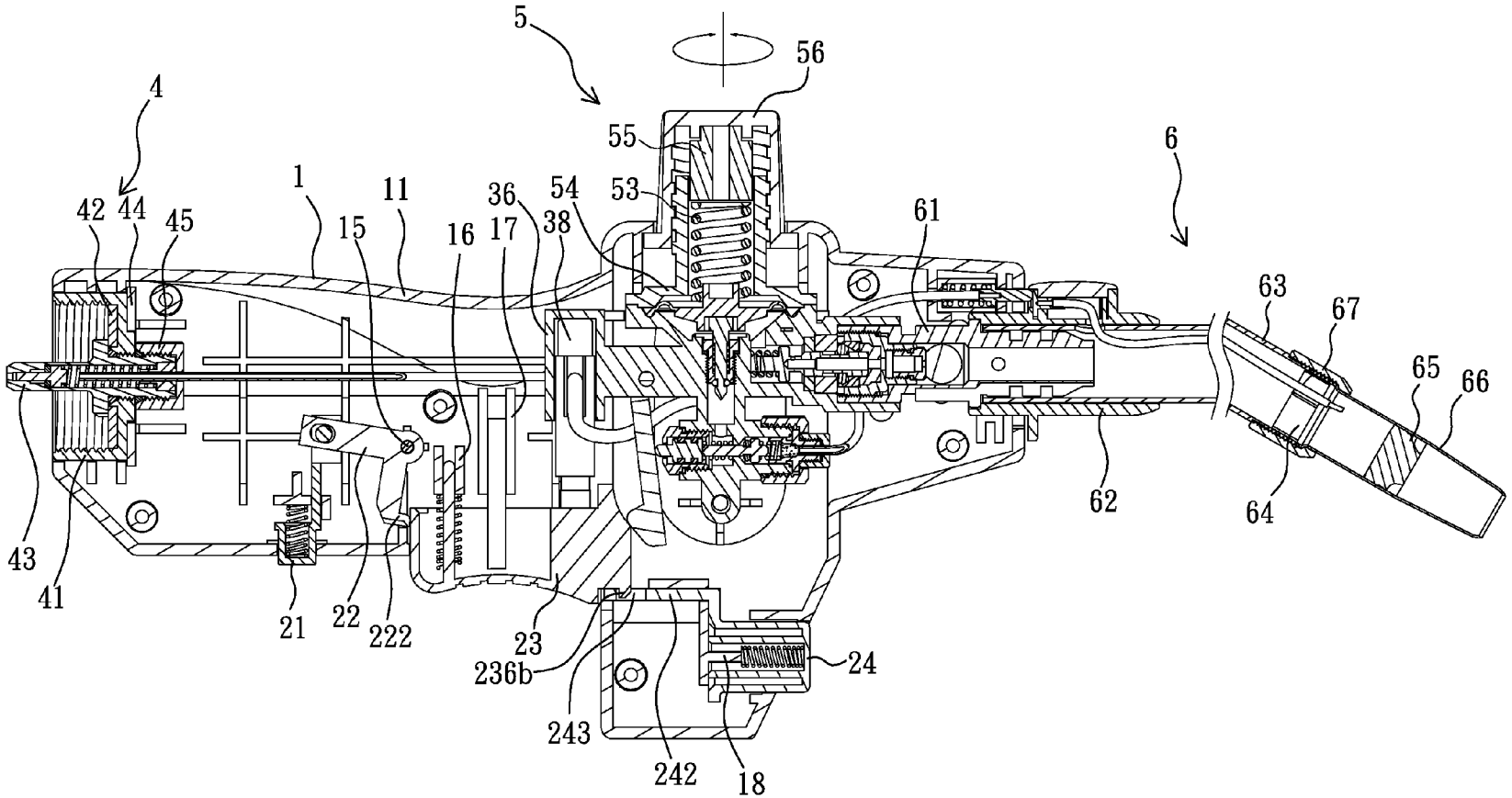
FIG. 10*a* is a cross sectional view illustrating the gas combustor being in the continuous gas supply state, according to the present invention.
Figure 10B:
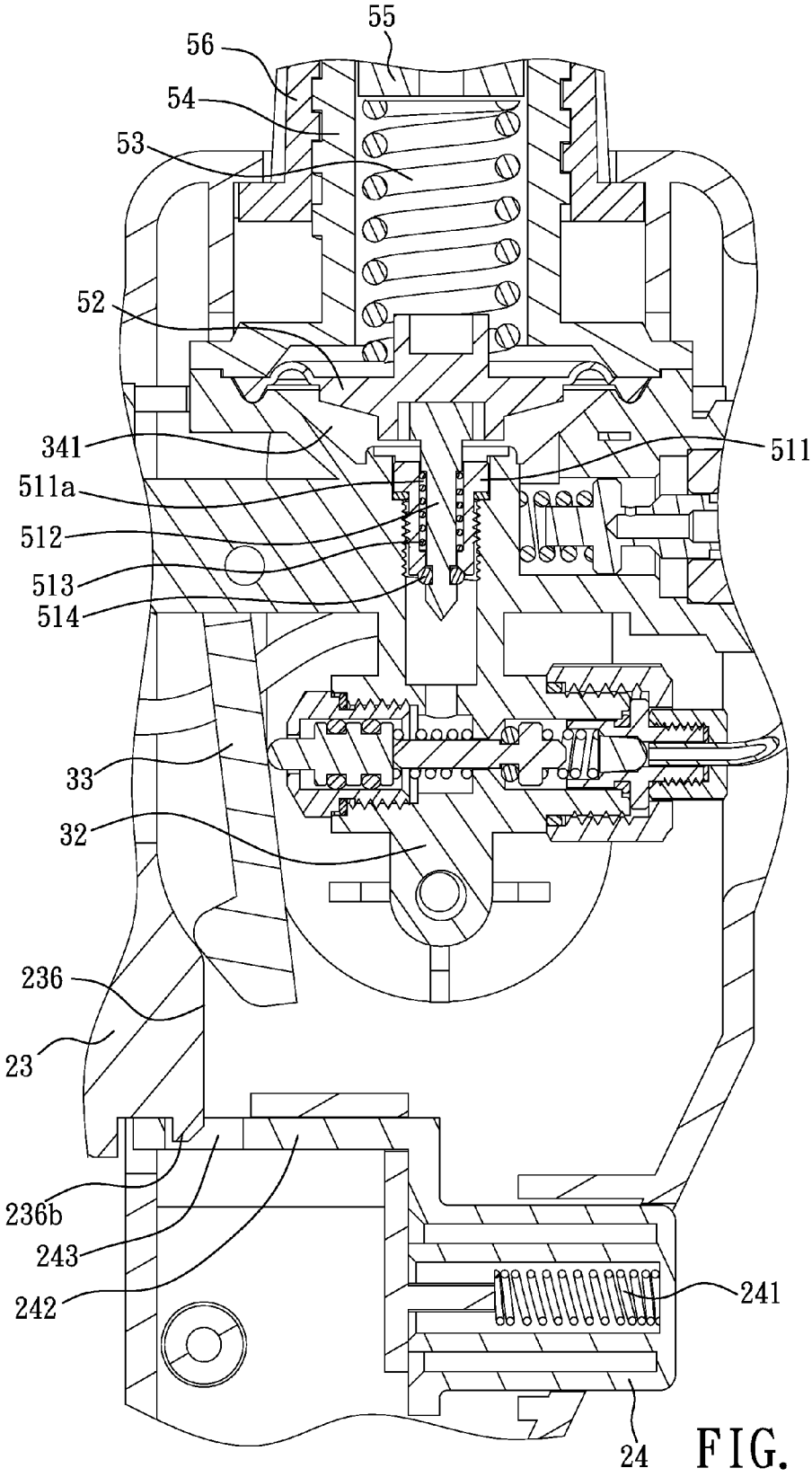
FIG. 10*b* is a partially enlarged view of FIG. 10*a.*

Moreover, the present invention is further provided with a continuous button 24, which is protruded from the opening 13 at the front bottom of the housing 1, the continuous button 24 is transversally sleeved with a third resilient member 241, e.g. a spring, the rear thereof is abutted against a continuous block sheet 18 formed in the housing 1, such that the continuous button 24 is equipped with an automatic recovery function, wherein the bottom of the continuous button 24 is transversally extended with an extension sheet 242 having an engagement part 243, e.g. a buckle slot, at the inner end. When the control button 23 is pressed to be in a retracted state, the continuous button 24 is enabled to be directly pressed, so the engagement part 243 and the buckle part 236*b* form a buckle effect as shown in FIG. 10*a* and FIG. 10*b*, thereby after the control button 23 is no longer pressed by the external force, the control button 23 is not automatically recovered and the gas intake control valve 32 formed in the base seat 3 can continuously supply the combustion gas to the pressure stabilizing device 5.

Figure 5:
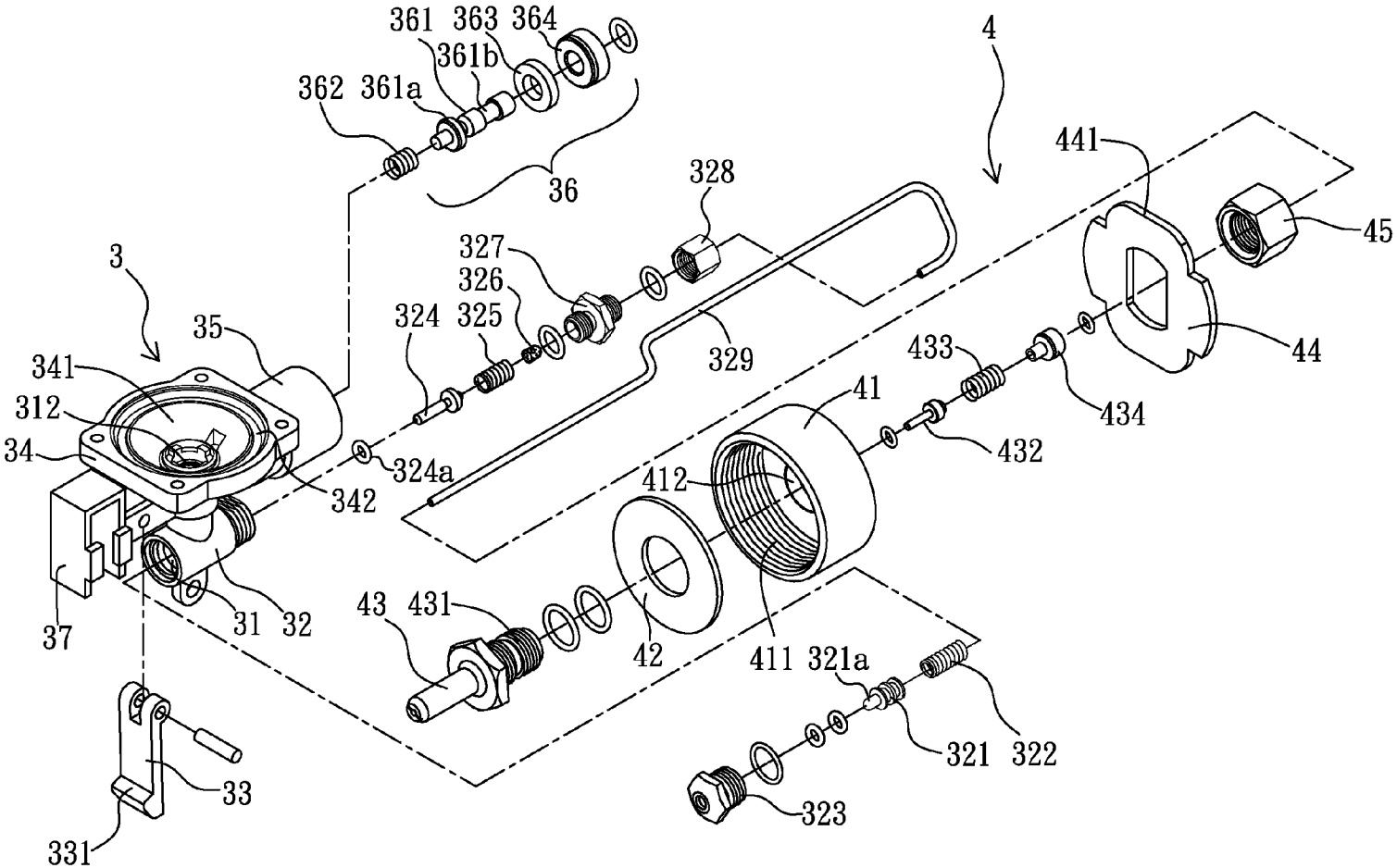
FIG. 5 is an exploded perspective view illustrating the base seat, the pivotal connection device and the gas intake control valve, according to the present invention.

The base seat 3 is an integrally-formed base seat member, a stepped seat hole 31 is formed at its axial direction, and the seat hole 31 allows the gas intake control valve 32 to be installed therein to control the supplying or terminating the combustion gas. As shown in FIG. 3, FIG. 4 and FIG. 5, the gas intake control valve 32 inserts a valve rod 321 and a fourth resilient member 322, e.g. a spring, from the rear of the seat hole 31, and a rear end cover 323 is combined with the seat hole 31, such that a valve button 321*a* at the rear of the valve rod 321 can protrude from the rear end cover 323. The front of the seat hole 31 is in sequence installed with a thimble valve 324, a fifth resilient member 325, e.g. a spring, and a filter 326, for example copper particles being formed as a sintered member and inserted into a intermediate pipe 327 and combined at the front of the seat hole 31, so the filter 326 is accommodated in the intermediate pipe 327, and one end of the thimble valve 324 is sleeved with the fourth resilient member 322, and abutted against the valve rod 321, the fifth resilient member 325 is disposed between the other end thereof and the filter 326; lastly a front end cover 328 is combined with the intermediate pipe 327, thereby the procedure of installing the gas intake control valve 32 in the seat hole 31 is finished. And one end of a convey pipe 329 passes through the front end cover 328 and the intermediate pipe 327, and is disposed adjacent to the filter 326, the other end thereof is connected to the pivotal connection device 4.

Figure 8B:
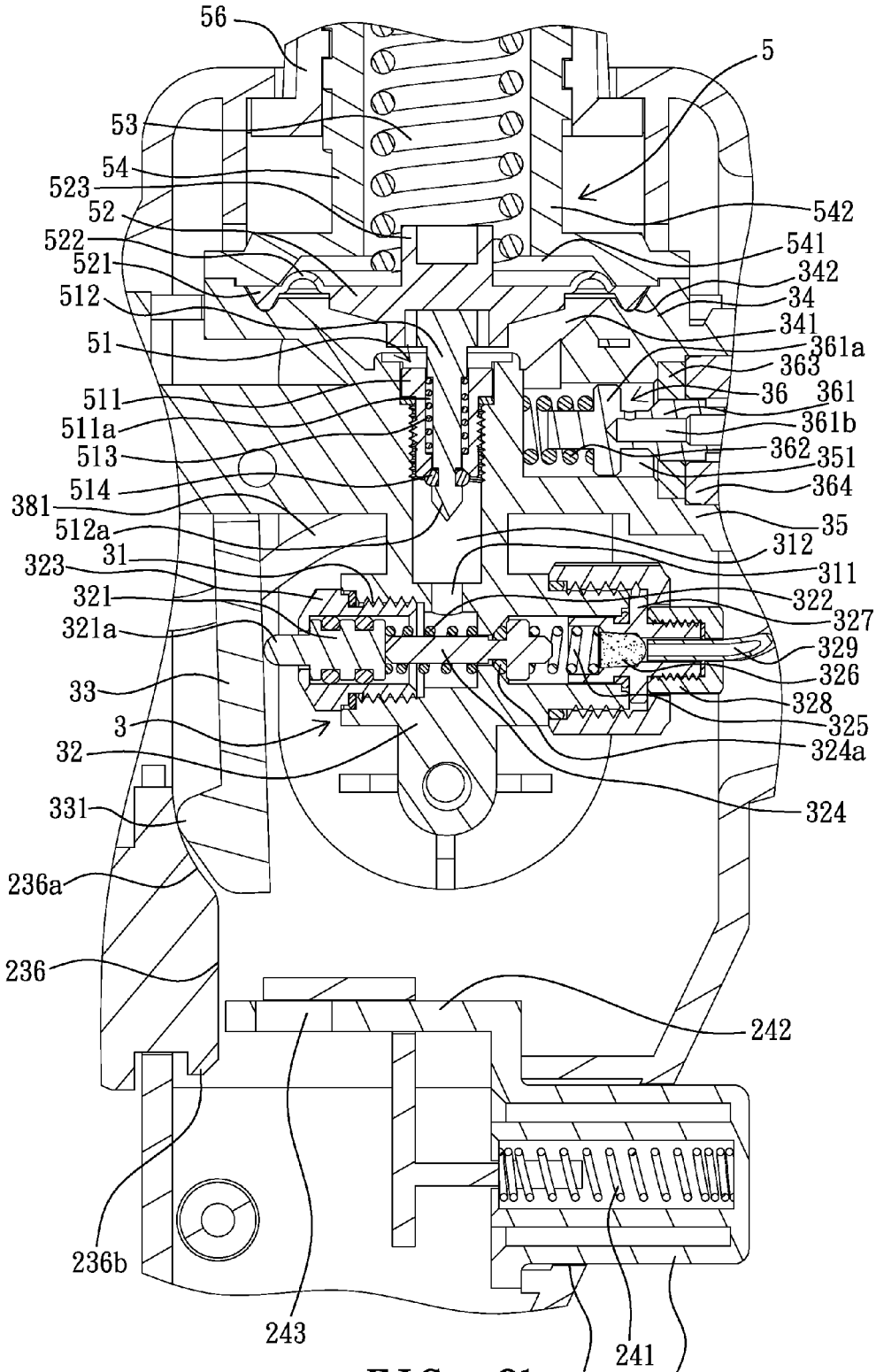
FIG. 8*b* is partially enlarged view of FIG. 8*a;*
Figure 9B:
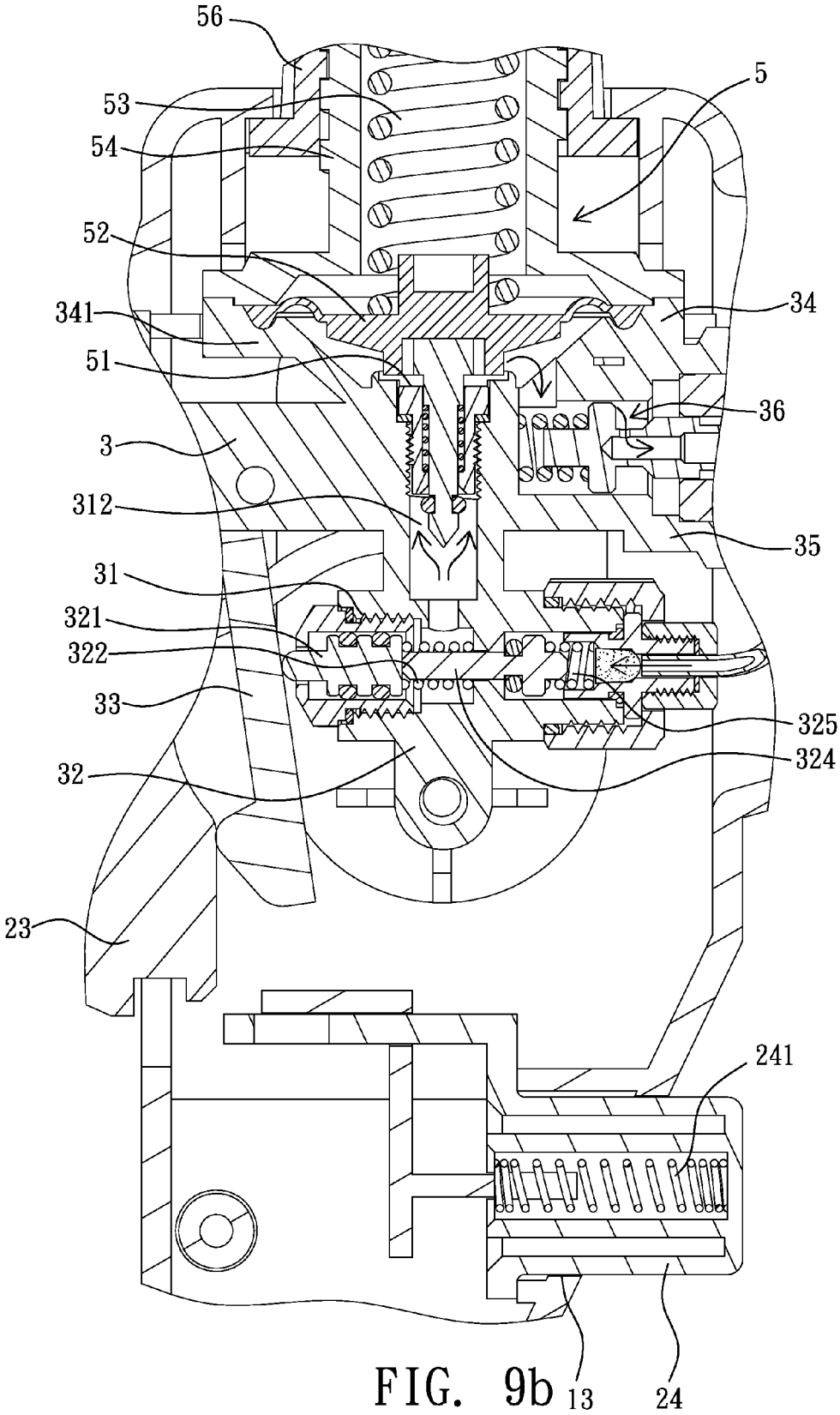
FIG. 9*b* is a partially enlarged view of FIG. 9*a;*

As shown in FIG. 3, FIG. 4, FIG. 8*a* and FIG. 8*b*, the rear of the base seat 3 is pivoted with the swing sheet 33, the lateral surface thereof is adjacent to the valve button 321*a*, the bottom thereof has an inclined protruding hook 331 which is in contact with the extrusion part 236*a*, also formed in an inclined state, of the control button 23. As such, when the control button 23 is pressed, the extrusion part 236*a* extrudes the protruding hook 331 of the swing sheet 33, thereby the swing sheet 33 is moved and pressed toward the valve button 321*a*, as shown in FIG. 9*a* and FIG. 9*b* wherein the valve rod 321 compresses the fourth resilient member 332 and axially pushes the thimble valve 324, the fifth resilient member 325 is compressed so a seal ring 324*a* of the thimble valve 324 is removed from a neck hole 311 having a smaller aperture inside the seat hole 31. So the gaseous/liquid fuel conveyed by the convey pipe 329 can pass through the filter 326 and the neck hole 311, then enter an gas intake channel 312 longitudinally communicated to the top of the seat hole 31 so as to further enter a bottom plate 34 installed above the gas intake channel 312. The interior of the bottom plate 34 is formed with a cone-shaped bottom plate chamber 341, and the bottom thereof is transversally communicated with an engagement pipe 35.

The interior of the engagement pipe 35 is installed with a transversally-stepped pipe slot 351, a gas outtake control valve 36 is installed therein, the gas outtake control valve 36 has a thimble valve 361 having one end being sleeved with an eighth resilient member 362, e.g. a spring, and the other end being sleeved with a gas blocking ring 363 and a position ring 364 installed at the middle portion of the pipe slot 351. When a sleeve pipe 61 of the flame device 6 is not inserted in the front of the pipe slot 351, with the stretch effect of the eighth resilient member 362, a convex ring 361*a* of the thimble valve 361 is tightly adjacent to the gas blocking ring 363 for forming a combustion gas termination state. When the sleeve pipe 61 of the flame device 6 is inserted in the front of the pipe slot 351, a nozzle seat 611 at the rear of the sleeve pipe 61 pushes the thimble valve 361, the eighth resilient member 362 is therefore compressed and the combustion gas is allowed to pass through the gap defined between the convex ring 361*a* and the pipe slot 351 to enter a gas guiding pipe 361*b* inside the thimble valve 361, and is ejected from an ejection nozzle 612 installed at the front of the nozzle seat 611.

Moreover, the rear of the base seat 3 is longitudinally and protrudingly installed with a fasten seat 37 allowing the top of a piezoelectric device 38 to be installed, and the bottom of the piezoelectric device 38 is connected to the front of the control button 23. The piezoelectric device 38 has a wire 381 extended and connected to an electric conductive terminal 382 installed at the periphery of the opening 13 at the front of the housing 1, the rear of the electric conductive terminal 382 is sleeved with a ninth resilient member 383 so as to be retractable, and the electric conductive terminal 382 and the ninth resilient member 383 are both installed in a terminal seat 384.

Referring to FIG. 3, FIG. 4 and FIG. 5, the pivotal connection device 4 is fastened in the opening 13 at the rear of the housing 1, and has a connection ring 41 formed with a connection part 411 therein, and a ring hole 412 communicated with the front wall of the connection part 411. The connection part 411 is designed with respect to the joint part at the top of a canned gas, the connection part 411 can be, but not limited to, threads. A damping ring sheet 42 is installed between the inner wall of the ring hole 412 of the connection ring 41 and the connection part 411, and a joint part 431 at one end of a filling nozzle 43 passes through the ring sheet 42, the ring hole 412 and a fasten sheet 44, then is combined with a fasten end cover 45, and one end of the convey pipe 329 passes through the fasten end cover 45 and enters into the filling nozzle 43 for receiving the gaseous/liquid fuel stored in the canned gas. As shown in FIG. 5 and FIG. 8*a*, the interior of the filling nozzle 43 is in sequence installed with a thimble valve 432, a sixth resilient member 433 and an end plug 434 disposed in the fasten end cover 45. As such, when the connection ring 41 is connected to the canned gas, the gaseous/liquid fuel is introduced from the filling nozzle 43 and conveyed by the convey pipe 329 for entering the gas intake control valve 32 inside the seat hole 31 of the base seat 3. As a matter of fact, the connection ring 41 utilizes plural flanges 441 formed at the periphery of the fasten sheet 44 to be sleeved in a positioning slot correspondingly formed in the opening 13 at the rear of the housing 1 for the purpose of fastening.

Figure 6:
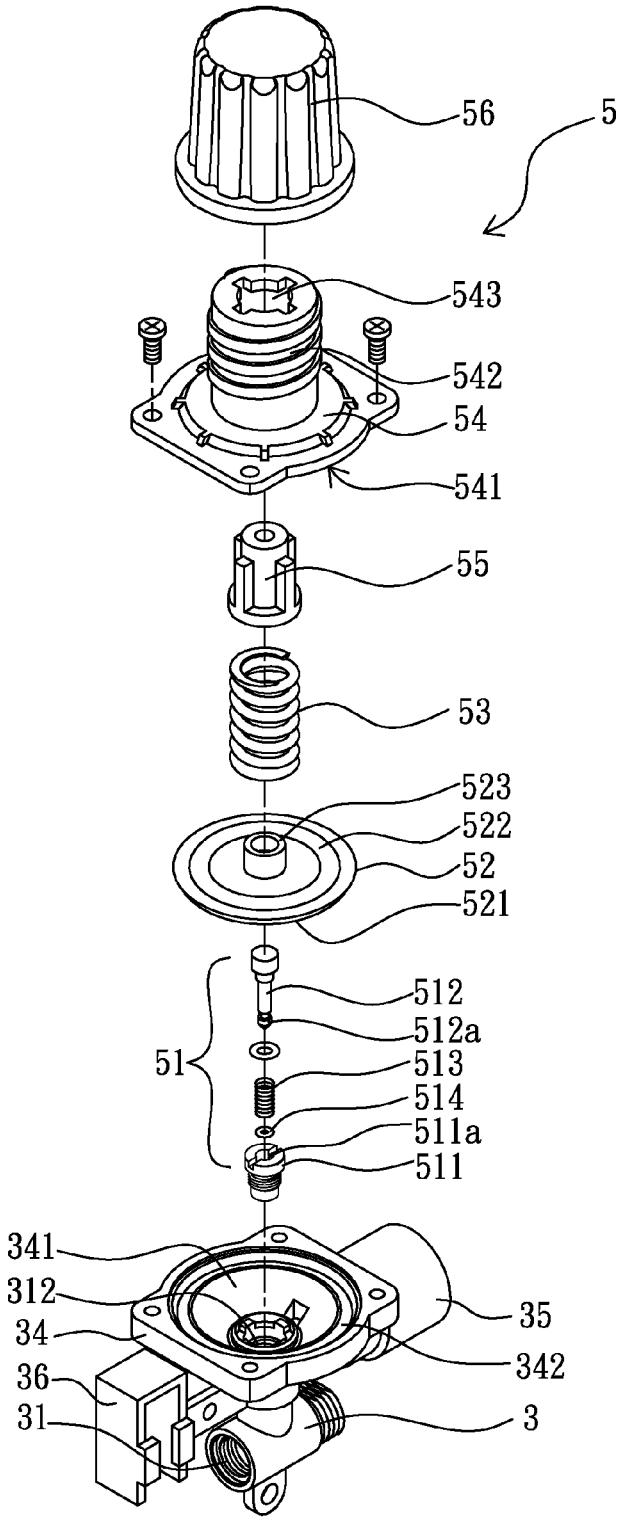
FIG. 6 is an exploded perspective view illustrating the pressure stabilizing device, according to the present invention.

Referring to FIG. 3, FIG. 4 and FIG. 6, the pressure stabilizing device 5 consists of a regulation valve 51, a partition membrane 52, a retractable spring 53 and a top plate 54. The regulation valve 51 utilizes a shaft tube 511 for being combined at the top of the gas intake channel 312, then a head part 512*a* formed at the bottom of an elevation rod 512 penetrates a seventh resilient member 513 then further passes through a central tube hole 511*a* of the shaft tube 511, then is sleeved with a seal ring 514; the top of the elevation rod 512 is combined at the bottom of the partition membrane 52. The partition membrane 52 is an elastic disc member made of a polymer material, and disposed between the bottom and the top plates, 34, 54, the periphery thereof is downwardly protruded with an annular angled tenon 521 so as to be received in a plate slot 342 preset at the top periphery of the bottom plate chamber 341, and be pressed by the periphery of the top plate 54. The partition membrane 52 has a membrane ring 522 having a thinner dimension at the inner edge of the angled tenon 521, the center of the top surface is upwardly extended with a protrusion ring 523, after being sleeved with the retractable spring 53, the retractable spring 53 is received in a top plate chamber 541 formed inside the top plate 54.

The technology feature of the pressure stabilizing device 5 is to be equipped with a function of adjusting pressure, i.e. the center of the top of the top plate 54 is longitudinally protruded with a top plate pipe 542 having a non-round positioning hole 543 at the top, and an elevation press block 55 having a cross shape corresponding to the positioning hole 543 is installed in the positioning hole 543, the bottom of the elevation press block 55 is adjacent to the retractable spring 53, the top thereof is connected to the pressure adjusting button 56 of the top plate pipe 542, the pressure adjusting button 56 is exposed outside the opening 13 at the top of the housing 1 for being easily to be operated. As such, when the pressure adjusting button 56 is rotated, the elevation press block 55 forms a compressing or stretching effect to the retractable spring 53, so as to adjust the pressure of the gaseous/liquid fuel entering the pressure stabilizing device 5. As shown in FIG. 8*b*, when the pressure adjusting button 56 is not operated, the retractable spring 53 applies a fixed pressure to the partition membrane 52, such that the seal ring 514 sleeved on the elevation rod 512 is disposed below the tube hole 511*a* of the shaft tube 511 for forming an opening state.

Referring to FIG. 6, for combing the bottom and the top plates 34, 54, the peripheries of the two plates are fastened with each other through conventional connection members, e.g. screws. But the combination means of the bottom and top plates 34, 54 is not limited by being combined through screws, the bottom and top plates 34, 54 can also be combined with a buckling or riveting means.

Referring to FIG. 9*b*, when the gas intake control valve 32 is pushed by the swing sheet 33 for being in the opening state, the gaseous/liquid fuel received by the pivotal connection device 4 is conveyed through the convey pipe 329 to pass through the seat hole 31 inside the base seat 3, the gas intake control valve 32, the gas intake channel 312 and the regulation valve 51 for being accommodated in the bottom plate chamber 341 below the partition membrane 52, such that the combustion gas is enabled to pass through the gas outtake control valve 36 in the engagement pipe 35 then ejected from the ejection nozzle 612 installed in the flame device 6; because the aperture of the ejection nozzle 612 is relatively smaller, excessive combustion gas or the liquid fuel which has not completely vaporized yet are rapidly filled and remained in the bottom plate chamber 341. As shown in FIG. 10*b*, when the pressure inside the bottom plate chamber 341 is rapidly increased, the partition membrane 52 is forced to upwardly move to compress the retractable spring 53, at this moment, the elevation rod 512 is upwardly moved and the seventh resilient member 513 is stretched, and the tube hole 511*a* is sealed through the seal ring 514 for terminating the gaseous/liquid fuel supply.

When the combustion gas inside the bottom plate chamber 341 is gradually ejected from the ejection nozzle 612, the pressure inside the bottom plate chamber 341 is decreased, so the retractable spring 53 is recovered, and the partition membrane 52 is downwardly pushed, so the elevation rod 512 is downwardly pushed and the seventh resilient member 513 is compressed, thereby the gaseous/liquid fuel supply state as shown in FIG. 9*b* is formed again. As a matter of fact, the speed of the fuel flowing between the base seat 3 and the pressure stabilizing device 5 is very fast, the partition membrane 52 and the elevation rod 512 are also rapidly and reciprocally moved, so the fuel can be completely vaporized to form the combustion gas, thereby a constant pressure effect is obtained.

Figure 7:
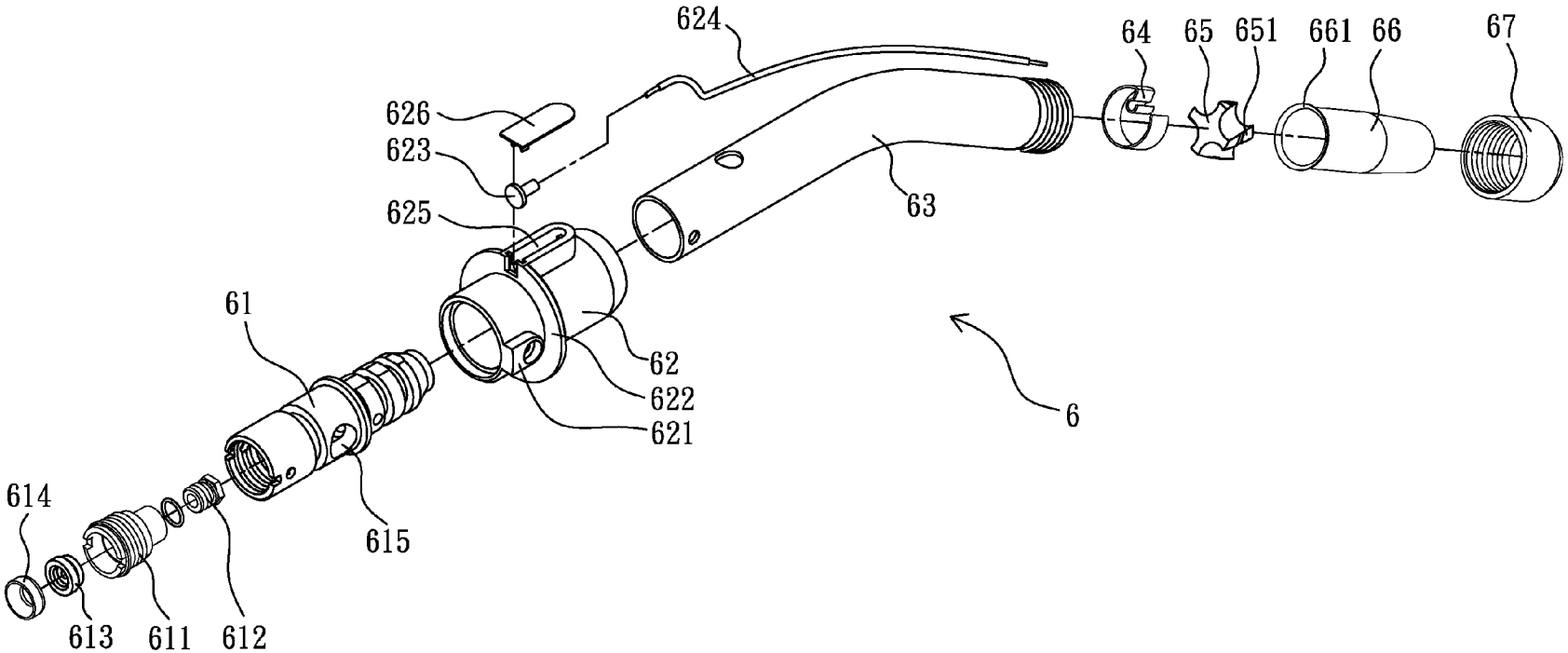
FIG. 7 is an exploded perspective view illustrating the flame device, according to the present invention.

Referring to FIG. 3, FIG. 4 and FIG. 7, the flame device 6 utilizes the sleeve pipe 61 to be sleeved in the engagement pipe 35, the rear of the sleeve pipe 61 is installed with a nozzle seat 611, the front thereof is installed with the ejection nozzle 612, the rear thereof is provided with a resilient engagement ring 613 and a guide ring 614, the interior of the guide ring 614 is formed with an inclined surface to guide the thimble valve 361 to be inserted in the engagement ring 613, such that the combustion gas which is completely vaporized and having a constant pressure is ejected from the ejection nozzle 612. The middle portion of the sleeve pipe 61 is formed with plural ventilation holes 615 allowing air to be introduced from an air guiding slot 19 preset at the periphery of the opening 13 at the front of the housing 1 then enter the sleeve pipe 61 via the ventilation holes 615 for being mixed with the combustion gas ejected from the ejection nozzle 612.

Moreover, the sleeve pipe 61 is provided with a detach seat 62 having an outer pipe 63 inside for being connected to a conventional connection member, e.g. a screw, passing through a positioning convex block 621 radially preset at the rear portion of the detach seat 62 and the outer pipe 63, then being fastened with the sleeve pipe 61. The detach seat 62 is radially protruded with a seat ring 622, a notch of the seat ring 622 is fastened with a contact terminal 623 which is received in a terminal slot 625 integrally extended at the front of the seat ring 622, and a seal cover 626 is used to seal the terminal slot 625, a wire 624 connected to the contact terminal 623 enters the outer pipe 63 and one end of the wire 624 is fastened with a wire positioning ring 64 installed at the inner front end of the outer pipe 63.

For generating a special flame effect, another gas guiding component 65 is installed in the flame pipe 66, and a connection ring cover 67 is sleeved on the flame pipe 66, and abutted against a flange 661 formed at the rear, then combined at the front of the outer pipe 63. The front of the gas guiding component 65 can be provided with, e.g. but not limited to, inclined guiding sheets 651 rotating toward the same direction, so when the mixed combustion gas passes through the inclined guiding sheets 651, a turbine flame can be formed for enhancing the combustion effect.

When the flame device 6 is connected to the engagement pipe 35, the positioning convex block 621 is aimed and inserted into a concave slot 131 radially formed in the opening 13 at the front of the housing 1, because the positioning convex block 621 is restrained by the stop block 132 at the rear of the opening 13 as shown in FIG. 3, the positioning convex block 621 can only be rotated to a pre-determined angle, e.g. 90 degrees, toward one direction, such that the positioning convex block 621 is abutted against the inner wall of the opening 13, and the sleeve pipe 61 is inserted in the pipe slot 351 of the engagement pipe 35, such that an airtight connection is formed between the gas outtake control valve 36 and the nozzle seat 611, and the seat ring 622 of the detach seat 62 rotates along the electric conductive terminal 382 till the notch at the rear of the contact terminal 623 being moved to be in contact with the electric conductive terminal 382, so as to form an electrical connection. If the flame device 6 is desired to be detached, only an operation of reverse rotation is needed to be processed to allow the positioning convex block 621 to be in contact with the stop block 132 for removing the flame device 6, such that the electric conductive terminal 382 and the contact terminal 623 and the gas outtake control valve 36 and the nozzle seat 611 are separated, thereby the gas outtake control valve 36 is in the closing state for stopping the ejection of the combustion gas.

When the piezoelectric device 38 is compressed, the generated static electricity is transmitted through the wire 371, the electric conductive terminal 382, the contact terminal 623 and the wire 624, and sparks are generated between the wire 624 and the inner wall of the flame pipe 66 so as to ignite the mixed combustion gas passing the gas guiding component 65.

In actual practice, please refer to FIG. 1, FIG. 2, FIG. 8*a* and FIG. 8*b*, a user holds the housing 1 with one hand, the recessed part between the thumb and the index finger of the user abuts the protrusion part at the rear of the pressure adjusting button 56, then uses his middle finger to press the latching button 21, such that the latch end 222 of the connection rod 22 pivoted above is backwardly moved for releasing the locking state of the control button 23; then the user uses his index finger to press the control button 23, so during the upward movement, the swing sheet 33 of the base seat 3 is actuated and the piezoelectric device 38 is compressed, such that the swing sheet 33 pushes the gas intake control valve 32 in the base seat 3, for forming the opening state as shown in FIG. 9*a* and FIG. 9*b*.

At this moment, the gas/liquid fuel supplied by the canned gas, which is connected with the pivotal connection device 4, passes through the convey pipe 329, the seat hole 31, the gas intake control valve 32, the gas intake channel 312, the regulation valve 51 to the location of the partition membrane 52 for processing pressure stabilizing, then passes through the gas outtake control valve 36 of the engagement pipe 35 for being ejected from the ejection nozzle 612 in the sleeve pipe 61, so the combustion gas which is completely vaporized and having a constant pressure is ejected into the sleeve pipe 61 for being mixed with air, the mixed combustion gas passes through the outer pipe 63 for entering the flame pipe 66, and formed as a special airflow through the guiding effect of the gas guiding component 65 then ejected from the pipe opening; the static electricity generated by the piezoelectric device 38 which is synchronously pressed by the control button 23 is transmitted by the wires 381, 624 for generating sparks at the inner wall of the flame pipe 66 so as to ignite the mixed combustion gas for processing the combustion operation.

As shown in FIG. 10*a*, the user uses another hand to press the continuous button 24, and the extension sheet 242 extends to the front bottom of the control button 23, so the engagement part 243 of the continuous button 24 is buckled with the buckle part 236*b* at the front bottom of the control button 23. At this moment, the user can release his index finger, and the fuel in the canned gas can be continuously supplied to the flame pipe 66 for the purpose of combustion. As shown in FIG. 10*b*, when the fuel pressure filled in the partition membrane 52 is greater than the pressure applying to the partition membrane 52 by the elevating the press block 55 through the retractable spring 53, the partition membrane 52 would be bloated and the elevation rod 512 is driven to seal the shaft tube 511; when the fuel pressure filled in the partition membrane 52 is smaller than the pressure applying to the partition membrane 52 by the elevating the press block 55 through the retractable spring 53, the partition membrane 52 descends as shown in FIG. 9*b*, and the elevation rod 512 also descends for opening the shaft tube 511, thereby the fuel is enabled to enter the pressure stabilizing device 5.

If the combustion operation is desired to be terminated, the control button 23 is pressed again such that the buckling with the continuous button 24 is released, and the continuous button 24 is automatically recovered through the third resilient member 241, the control button 23 is automatically recovered through the second resilient member 233 and the piezoelectric device 38, and the latch end 222 of the connection rod 22 forwardly protrudes and is latched at the stop end 231 at the rear of the control button 23, the latch button 21 is automatically recovered through being downwardly pressed by the other end of the connection rod 22 and the stretch of the first resilient member 211.

The advantages of the present invention are: with the safety mechanism formed through the latch button, the connection rod and the control button, the operation procedure is more complicated and with certain level of difficulty, so unpredictable accidents caused by children playing with the gas combustor can be avoided, thereby complying with the safety regulations issued by countries such as the America or European Union; moreover, when the combustion operation is desired to be released, it can be easily carried out by simply pressing the control button again to releasing the interfere formed between the continuous button and the latch button and allowing to automatically recover to the original positions, and at the same time, the combustion gas supply is terminated for ceasing the flame, and a locking state is automatically formed; moreover, during the combustion gas supply, the pressure stabilizing device with adjustable pressure is equipped with functions of completely vaporizing the fuel and maintaining at a constant pressure. With the modularized design of the flame device, the flame device can be provided with different types of gas guiding components according to the actual combustion needs, and the flame device is installed in the opening at the front of the housing, and can be respectively formed with the combustion gas and electrical connections.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor, comprising:

a housing in which a base seat being installed, an engagement pipe at the front of said base seat being connected to a flame device exposed at the front of said housing, wherein the rear portion of said base seat being pivoted with a swing sheet, the inner surface thereof being adjacent to a gas intake control valve fastened in said base seat, and a convey pipe being connected between said gas intake control valve and a pivotal connection device installed at the rear of said housing; and a safety mechanism, installed at the bottom of said housing and including:

a latch button, longitudinally sleeved with a first resilient member, the top of said first resilient member being abutted in said housing, the top of said latch button being pivoted to one end of a connection rod, a bended portion of said connection rod being pivoted in said housing, and the other end of said connection rod being protrudingly formed with a latch end toward a control button; and a control button, the top opening being formed with a stop end at the location adjacent to said latch end, said stop end being formed in a locking state due to the interfere of said latch end; the interior of a hollow button chamber of said control button being longitudinally sleeved with a second resilient member, the top end of said second resilient member being abutted in said housing, and the top front of said control button being formed with an extrusion part;

through pressing said latch button, one end of said connection rod being raised, said latch end at the other end of said connection rod being inwardly retracted for releasing the locking state of said control button, so said control button being enabled to be pressed, and the extrusion part extruding said swing sheet, and said gas intake control valve being formed in an opening state, so the fuel being able to pass through the interior of said base seat for being ejected by said flame device.

2. The gas combustor as claimed in claim 1, further including a continuous button protruding at the front bottom of said housing, said continuous button is transversally sleeved with a third resilient member, the inner end is abutted in said housing, said bottom is transversally extended with an extension sheet; when said control button is pressed then said continuous bottom is pressed, said extension sheet protrudes to the bottom of said control button for preventing said control button from automatically and elastically recovering, such that said gas intake control valve is maintained in the opening state.

3. The gas combustor as claimed in claim 2, wherein the inner end of said extension sheet of said continuous button is formed with an engagement part, and the front bottom of said control button is correspondingly installed with a buckle part, said buckle part and said engagement part are able to be buckled.

4. The gas combustor as claimed in claim 1, wherein said extrusion part is an inward-retracted inclined surface, and the bottom of said swing sheet has a protruding hook having an inclined surface; when said inclined surface of said extrusion part is upwardly moved and in contact with said inclined surface of said protruding hook, said swing sheet is swung toward said gas intake control valve.

5. The gas combustor as claimed in claim 1, wherein said gas intake control valve allows a valve rod and a fourth resilient member to be installed from the rear of a seat hole transversally formed on said base seat, and a rear end cover is combined with said seat hole, so a valve button at the rear of said valve rod is enabled to protrude from said rear end cover and adjacent to said swing sheet; and the front of said seat hole is in sequence installed with a thimble valve and a fifth resilient member, and a intermediate pipe is combined at the front of said seat hole, said thimble valve is abutted against said valve rod, and two ends thereof are respectively sleeved with said fourth and said fifth resilient members, and a front end cover is combined with said intermediate pipe, and said convey pipe penetrates in said front end cover and said intermediate pipe.

6. The gas combustor as claimed in claim 5, wherein a filter is installed in said intermediate pipe, two ends of said filter are respectively adjacent to said fifth resilient member and said convey pipe.

7. The gas combustor as claimed in claim 1, wherein said pivotal connection device is installed with a connection ring having a connection part inside, ring holes of said connection part and said connection ring are in communication, and a joint part at one end of a filling nozzle passes through said ring holes and a fasten sheet and is further combined with a fasten end cover, and one end of said convey pipe passes through said fasten end cover and penetrates into said filling nozzle.

8. The gas combustor as claimed in claim 7, wherein said filling nozzle is in sequence installed with a thimble valve, a sixth resilient member and an end plug disposed in said fasten end cover.

9. The gas combustor as claimed in claim 7, wherein the periphery of said fasten sheet is formed with plural flanges for being sleeved in a positioning slot correspondingly formed inside the opening at the rear of said housing.

10. The gas combustor as claimed in claim 1, further including a pressure stabilizing device installed on a bottom plate disposed above said base seat, the interior of said bottom plate is formed with a cone-shaped bottom plate chamber which is in communication with said gas intake control valve of said base seat through a gas intake channel, the bottom of said bottom plate chamber is communicated with an engagement pipe allowing said flame device to be connected; wherein, said pressure stabilizing device includes:

a regulation valve having a shaft tube connected to the top of said gas intake channel, and a head part at the bottom of an elevation rod passes through a seventh resilient member and a tube hole at the center of said shaft tube then is sleeved with a seal ring;

a partition membrane, which is an elastic disc member, the bottom thereof is adjacent to said elevation rod, the periphery is downwardly protruded with an annular angled tenon which is received in a plate slot preset at the periphery of said bottom plate chamber for covering said bottom plate, the inner edge of said angled tenon has a membrane ring having a thinner dimension;

a retractable spring, the bottom thereof is adjacent to the center of the top surface of said partition membrane; and a top plate engaged with said bottom plate, such that said angled tenon is pressed by the periphery of said top plate, and the top of said retractable spring is abutted against a inner wall of top plate formed inside said top plate;

when the fuel passes through said gas intake control valve, said gas intake channel and said regulation valve, the pressure inside said bottom plate chamber is rapidly increased, said partition membrane is forced to upwardly move for compressing said retractable spring, and said elevation rod is upwardly moved and said seventh resilient member is stretched, such that said tube hole is sealed by said seal ring for terminating the fuel supply; when said combustion gas in said bottom plate chamber is gradually ejected through said flame device, the pressure inside said bottom plate chamber is gradually decreased, thereby said retractable spring is stretched and recovered, said partition membrane is pushed to descend and said elevation rod further descends, and said seventh resilient member is compressed, for forming a fuel supply state.

11. The gas combustor as claimed in claim 10, wherein the center of the top of said top plate is longitudinally protruded with a top plate pipe, the top thereof is formed with a positioning hole, an elevation press block is sleeved in said positioning hole, the bottom of said elevation press block is adjacent to said retractable spring, and the top thereof is connected to a pressure adjusting button installed on said top plate pipe, said pressure adjusting button is exposed outside said opening preset at the top of said housing; through rotating said pressure adjusting button, said elevation press block is enabled to form a compress or stretch effect to said retractable spring, for adjusting the pressure inside said partition membrane.

12. The gas combustor as claimed in claim 11, wherein said positioning hole is a non-round orifice, and the cross shape of said elevation press block is corresponding to said positioning hole.

13. The gas combustor as claimed in claim 1, wherein a gas outtake control valve is installed in a transversal pipe slot of said engagement pipe, one end of said thimble valve of said gas outtake control valve is sleeved with an eighth resilient member, the other end is sleeved with a gas blocking ring and a positioning ring; a sleeve pipe is installed at the rear of said flame device, the rear of said sleeve pipe is combined with a nozzle seat, an ejection nozzle is installed at the front of said nozzle seat, the rear is installed with an engagement ring and a guide ring, and the middle portion of said sleeve pipe is formed with plural ventilation holes for introducing air from an air guiding slot preset at the front of said housing, so the air enters said sleeve pipe through said ventilation holes for being mixed with said combustion gas ejected from said ejection nozzle;

when said sleeve pipe is not inserted in said pipe slot, through the stretch of said eighth resilient member, a convex ring radially formed on said thimble valve is tightly adjacent to said gas blocking ring for forming a combustion gas termination state; when said sleeve pipe is inserted in said pipe slot, said nozzle seat of said sleeve pipe pushes said thimble valve, said eighth resilient member is therefore compressed and said combustion gas is allowed to pass through the gap defined between said convex ring and said pipe slot to enter a gas guiding pipe installed inside said thimble valve, and ejected from said ejection nozzle installed at the front of said nozzle seat.

14. The gas combustor as claimed in claim 1, further including a piezoelectric device, the top of said piezoelectric device is disposed in the fasten seat longitudinally installed at the rear of said base seat, and the bottom of said fasten seat is connected to the front of said control button, said piezoelectric device is extended with a wire, the other end is extended into said flame device.

15. The gas combustor as claimed in claim 14, wherein said wire of said piezoelectric device is extended and connected to an electric conductive terminal installed at the periphery of said opening at the front of said housing, the rear of said electric conductive terminal is sleeved with a ninth resilient member; a sleeve pipe is installed at the rear of said flame device, said sleeve pipe is provided with a detach seat in which an outer pipe is connected, said detach seat is radially installed with a seat ring, a notch of said seat ring is fastened with a contact terminal, said contact terminal is connected with another wire penetrating into said outer pipe, and one end of the another wire is fastened on a wire positioning ring at the front of said outer pipe.

16. The gas combustor as claimed in claim 15, wherein the rear portion of said detach seat is radially installed with a positioning convex block, and a concave slot is radially formed in said opening at the front of said housing, and a stop block is installed at the rear of said opening; said detach seat and said positioning convex block are inserted from said opening at the front of said housing, such that said positioning convex ring is restrained by said stop block for only capable of rotating to a preset angle toward one direction, so said positioning convex block is abutted against the inner wall of said opening, thereby the connection of said detach seat and said housing is formed.

17. The gas combustor as claimed in claim 15, wherein the front of said outer pipe is connected with a flame pipe in which a gas guiding component is installed, and a connection ring cover is sleeved on a flange formed at the rear of said flame pipe and combined at the front of said outer pipe.

* * * * *